US012768244B1

(12) United States Patent
Adkins

(10) Patent No.: US 12,768,244 B1
(45) Date of Patent: Oct. 20, 2026

(54) BARRIER VALVE WITH VARIABLE CHOKING CAPABILITIES

(71) Applicant: Halliburton Energy Services, Inc., Houston, TX (US)

(72) Inventor: Darrell Adkins, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/225,731

(22) Filed: Jun. 2, 2025

(51) Int. Cl.
*E21B 34/06* (2006.01)
*E21B 34/16* (2006.01)

(52) U.S. Cl.
CPC ..... *E21B 34/066* (2013.01); *E21B 34/16* (2013.01); *E21B 2200/02* (2020.05); *E21B 2200/04* (2020.05)

(58) Field of Classification Search
CPC ..... E21B 2200/04; E21B 34/10; E21B 34/066
See application file for complete search history.

(56) References Cited

U.S. PATENT DOCUMENTS 3,442,328 A * 5/1969 Nutter ..... E21B 23/006 166/152
2012/0085547 A1* 4/2012 Arizmendi, Jr. ..... E21B 43/123 166/163
2012/0318525 A1* 12/2012 Coghill ..... E21B 34/06 251/366
2013/0327537 A1* 12/2013 Anyan ..... E21B 34/103 166/373
2014/0083682 A1 3/2014 Grigsby et al.
2014/0083714 A1 3/2014 Grigsby
2015/0226033 A1 8/2015 Inglis
2017/0122070 A1 5/2017 McNeilly
2019/0257174 A1 8/2019 Andreychuk et al.
(Continued)

FOREIGN PATENT DOCUMENTS

WO 2022096326 A1 5/2022
WO 2024110062 A1 5/2024

OTHER PUBLICATIONS

International Search Report and Written Opinion for International Patent Application No. PCT/US2025/033911 dated Feb. 27, 2025. PDF file. 10 pages.

(Continued)

*Primary Examiner* — Giovanna Wright
(74) *Attorney, Agent, or Firm* — Scott Richardson; C. Tumey Law Group PLLC

(57) ABSTRACT

A downhole valve system may include a downhole tubular having body portion and a central bore extending axially through the body portion. Production fluid is configured to flow along the central bore. The system may further include a bypass flow path extending axially through the downhole tubular between an upper opening and a lower opening axially offset from the upper opening. Additionally, the system may include a control valve disposed along the bypass flow path and configured to actuate between an open position and a closed position to control flow along the bypass flow path. Further, the system may include a ball valve disposed within the central bore in an axial position between the upper opening and the lower opening and configured to actuate between an open orientation to permit flow through the central bore and a closed orientation to block flow through the central bore.

21 Claims, 7 Drawing Sheets

(56) References Cited

U.S. PATENT DOCUMENTS

| | | | | |
|---|---|---|---|---|
| 2020/0386083 | A1 | 12/2020 | Presslie et al. | |
| 2022/0025751 | A1* | 1/2022 | Wensrich | E21B 43/26 |
| 2025/0052128 | A1 | 2/2025 | Barbee et al. | |

OTHER PUBLICATIONS

Halliburton. "FS2 fluid loss isolation barrier valve." Halliburton Data Sheet, 2024. H07007 Nov. 2024. PDF file. 2 pages.
Halliburton. "HS interval control valves." Halliburton Data Sheet, 2024. H06970 Nov. 2024. PDF file. 3 pages.
Halliburton. "Isolation barrier valve technology helps operational efficiency and run reliability." Halliburton Case Study, 2025. H014195 Sep. 2024. PDF file. 2 pages.
Halliburton. "Isolation Barrier Valves, Halliburton Completion Tools." Halliburton Catalog, 2018. PDF file. 8 pages.
Halliburton YouTube Video. "Halliburton's FS Fluid Loss Control Device." Uploaded Oct. 1, 2013. YouTube Website, https://www.youtube.com/watch?v=hTzK-Q2VMaA. Accessed Oct. 10, 2025.
Halliburton. "Accu-Pulse incremental positioning module." Halliburton Data Sheet, 2024. H06961 Dec. 2024. PDF file. 2 pages.
Halliburton. "Turing electro-hydraulic control system." Halliburton Company Website, https://www.halliburton.com/en/products/turing-electro-hydraulic-control-system. Accessed Oct. 10, 2025.
VoltaGrid YouTube Video. "Halliburton and VoltaGrid Hybrid Co Grid & Onsite Generation E Frac." Uploaded May 29, 2024. YouTube Website, https://www.youtube.com/watch?v=g20KMWFGQfU. Accessed Oct. 10, 2025.

* cited by examiner

BARRIER VALVE WITH VARIABLE CHOKING CAPABILITIES

BACKGROUND

After drilling a wellbore in a subterranean formation for recovering hydrocarbons such as oil and gas lying beneath the surface, various downhole tools may be run-in-hole to facilitate various operations (e.g., injection operations, production operations, etc.). During such operations, controlling fluid flow through production tubing may be beneficial. As such, a mechanical plug may be run-in-hole to block fluid flow through the central bore such that the fluid may be diverted to a downhole valve configured to control the fluid flow. Unfortunately, the flow rate through the downhole valve may be lower than the flow rate through the unplugged production tubing. To provide full flow rate through the production tubing, the mechanical plug must be retrieved and brought to surface. During subsequent operations, to control the flow via the downhole valve, the mechanical plug may need to be run-in-hole again. Retrieving and replacing the mechanical plug may be time-consuming and costly.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for providing interventionless and variable control of fluid flow through a downhole tubular and, more particularly, example embodiments may include a downhole valve assembly having a control valve disposed in a bypass flow path of a downhole tubular to control fluid flow through the bypass flow path and a ball valve disposed in a central bore of the downhole tubular to control fluid flow through the central bore. As set forth in greater detail below, an actuation assembly may be configured to actuate the control valve and the ball valve to various positions and/or orientations to generally control fluid flow through the downhole tubular.

Figure 1:
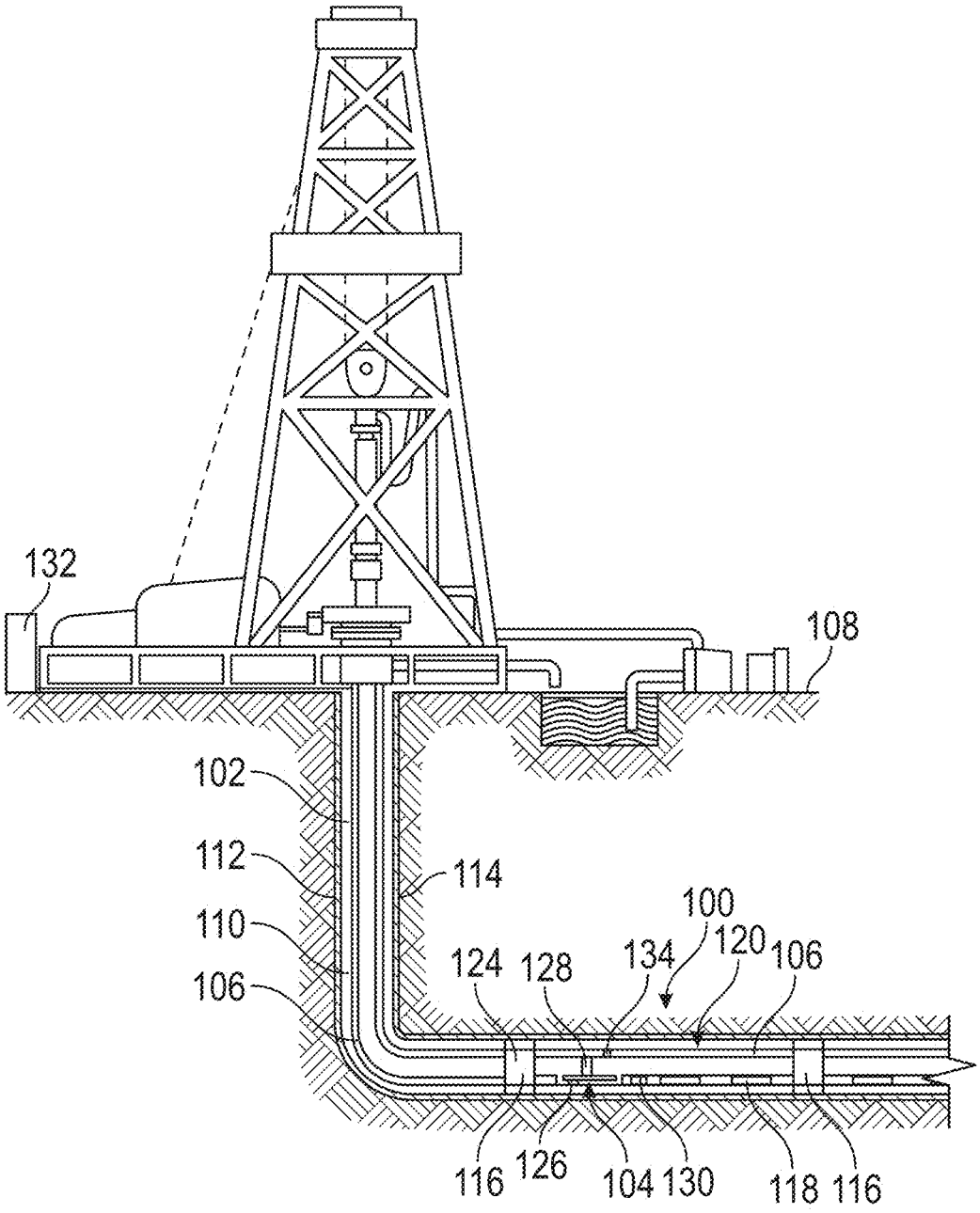
FIG. 1 illustrates an elevation view of a well system having a downhole valve assembly with interventionless and variable choking capabilities, in accordance with some embodiments of the present disclosure.

FIG. 1 illustrates an elevation view of a well system having a downhole valve assembly with interventionless and variable choking capabilities, in accordance with some embodiments of the present disclosure. As illustrated, a completion assembly 100 (e.g., an upper completion assembly, a lower completion assembly, etc.) may be secured within a wellbore 102 during completion operations. The completion assembly 100 may include at least one downhole valve assembly 104 for providing interventionless and variable control of fluid flow through a downhole tubular 106 extending along the wellbore 102. As set forth in greater detail below, the at least one downhole valve assembly 104 may include at least a portion of the downhole tubular 106. Moreover, the downhole tubular 106 may extend from the surface 108 of the wellbore 102 to any suitable portion of the wellbore 102.

Moreover, as illustrated, an annulus 110 may be formed between the downhole tubular 106 and a casing 112 cemented against a wellbore wall 114 of the wellbore. Alternatively, or additionally, the annulus 110 may be formed between the downhole tubular 106 and the wellbore wall 114. That is, the casing 112 may extend through only a portion of the wellbore 102. Further, the completion assembly 100 may include at least one packer assembly 116, a flow regulating system 118, etc. The at least one packer assembly 116 may be configured to prevent fluid flow through the annulus 110 at the at least one packer assembly 116. Accordingly, a production zone 120 may be formed between adjacent packer assemblies 116. Further, fluid may be configured to flow between a central bore 122 of the downhole tubular 106 and the annulus 110 via the flow regulating system 118.

Moreover, the at least one at least one downhole valve assembly 104 may be disposed proximate the at least one packer assembly 116. For example, as illustrated, the at least one downhole valve assembly 104 may be disposed below an upper completion packer 124. However, the at least one downhole valve assembly 104 may be disposed at any suitable position within the wellbore 102 to provide interventionless and variable control of fluid flow through the downhole tubular 106

As set forth in greater detail below, the at least one downhole valve assembly 104 may be configured to control fluid flow through the downhole tubular 106 via actuating a control valve 126 and a ball valve 128 between various position and/or orientations. Further, the at least one downhole valve assembly 104 may include an actuation assembly 130 configured to drive actuation of the control valve 126 and/or the ball valve 128 in response to receiving actuation instructions. A surface control system 132 may be configured to output instructions to the actuation assembly 130. Alternatively, or additionally, a downhole control system 134 may be configured to output actuation instructions to the actuation assembly 130.

Figure 2:
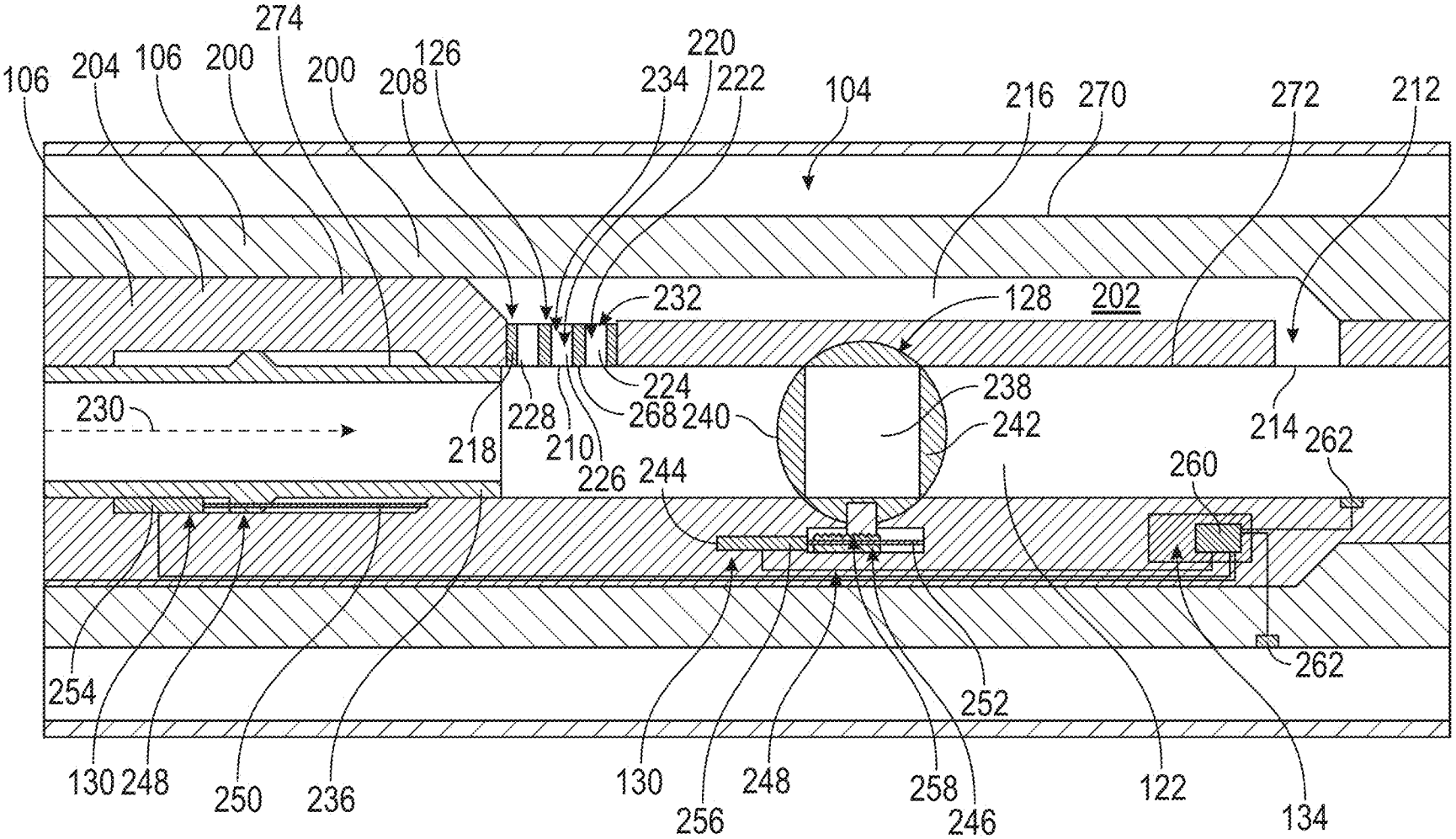
FIG. 2 illustrates a cross-sectional view of a downhole valve assembly in a first partially choked state, in accordance with some embodiments of the present disclosure.

FIG. 2 illustrates a cross-sectional view of a downhole valve assembly in a partially choked state, in accordance with some embodiments of the present disclosure. As illustrated, the downhole valve assembly 104 may include the downhole tubular 106 having a body portion 200 and a central bore 122 extending axially through the body portion 200. During various downhole operations, downhole fluid may be configured to flow through the downhole tubular 106 via the central bore 122. The downhole valve assembly 104 may also include a bypass flow path 202 for conveying fluid through at least a portion of the downhole tubular 106. The bypass flow path 202 may be configured to extend axially through the downhole tubular 106 and may be formed in the body portion 200 between the central bore 122 a radially outer surface 270 of the downhole tubular 106. Alternatively, or additionally, at least a portion of the bypass flow path 202 may be formed in a gap between a secondary tubular 204, disposed within the central bore 122, and the downhole tubular 106. The bypass flow path 202 may be formed in any suitable manner to provide a separate flow path than the central bore 122 for conveying fluid along at least a portion of the central bore 122.

Moreover, an upper portion 208 of the bypass flow path 202 may be fluidly connected to the central bore 122 via an upper opening 210, and a lower portion 212 of the bypass flow path 202 may be fluidly connected to the central bore 122 via a lower opening 214. The lower opening 214 is axially offset from the upper opening 210. For example, as illustrated, the lower opening 214 may be disposed downhole from the upper opening 210. As set forth in greater detail below, the downhole valve assembly 104 may be configured to redirect fluid flow through the downhole tubular 106 from the central bore 122 to the bypass flow path 202, via the upper opening 210 and/or the lower opening 214, in some valve states of the downhole valve assembly 104.

The bypass flow path 202 may be smaller than the central bore 122 such that blocking flow through the central bore 122 and directing flow through the bypass flow path 202 at least partially chokes the flow rate of the fluid flowing through the downhole tubular 106. That is, at least a portion of the bypass flow path 202 (e.g., the upper opening 210, a main bypass portion 216 of the bypass flow path 202, and/or the lower opening 214) may be smaller than the central bore 122. For example, the cross-sectional area of the main bypass portion 216 may be smaller than the cross-section area of the central bore 122. Alternatively, or additionally, the upper opening 210 and/or the lower opening 214 may have smaller cross-sectional areas than the central bore 122.

Moreover, the downhole valve assembly 104 may further include a control valve 126 disposed along the bypass flow path 202 to control flow along the bypass flow path 202. The control valve 126 may be disposed along any suitable portion of the bypass flow path 202. For example, as illustrated, the control valve 126 may be disposed at the upper opening 210 to control fluid flow between the central bore 122 and the bypass flow path 202 at the upper opening 210. Alternatively, the control valve 126 may be disposed in the main bypass portion 216 or at the lower opening 214.

The control valve 126 may include a valve body 218 configured to seal a portion of the bypass flow path 202. For example, as illustrated, the valve body 218 may be disposed in the upper opening 210 to seal the upper portion 208 of the bypass flow path 202 from the central bore 122. The control valve may also include at least one slot 220 extending through the valve body 218 such that fluid may flow through the control valve 126 via the at least one slot 220. As illustrated, the at least one slot 220 may include a plurality of slots 222 (e.g., a first slot 224, a second slot 226, a third slot 228, etc.) Further, the plurality of slots 222 may have different shapes and/or sizes. For example, the first slot 224 may be larger than second slot 226 such that the flow rate through the first slot 224 may be higher than the flow rate through the second slot 226. Additionally, the plurality of slots 222 may be axially offset. That is, the first slot 224, the second slot 226, and the third slot 228 may be axially offset from each other with respect to a central axis 230 of the downhole tubular 106. As illustrated, the first slot 224 may be disposed uphole from the second slot 226 and the third slot 228, and the second slot 226 may be disposed uphole from the third slot 228. However, the plurality of slots 222 may include any suitable orientation. Further, each slot (e.g., the first slot 224, the second slot 226, etc.) may include a group of corresponding slots. For example, the first slot 224 may include a first group of slots 232 that are axially aligned and circumferentially spaced about the control valve 126, the second slot 226 may include a second group of slots 234 that are axially aligned with each other but axially offset from the first group of slots 232, etc.

Moreover, the control valve 126 may include a control sleeve 236 configured to move to selectively block the at least one slot 220. For example, the control sleeve 236 may be configured to block fluid flow through only the first slot 224, block fluid flow through the first slot 224 and the second slot 226, block fluid flow through each slot of the plurality of slots 222, block fluid flow through none of the slots of the plurality of slots 222, or any other suitable combination. Selectively blocking fluid flow through the at least one slot 220 (e.g., the first slot 224, the second slot 226, the third slot 228, etc.) may allow the downhole valve assembly 104 to variably control the flow rate of fluid through the bypass flow path 202; thereby, allowing the downhole valve assembly 104 to variably control the flow rate of fluid through the downhole tubular 106. As illustrated, the control sleeve 236 may be positioned in an open position with the control sleeve 236 axially offset from the at least one slot 220 to permit fluid flow through the at least one slot 220. That is, the control sleeve 236 may be axially offset from the first slot 224, the second slot 226, and the third slot 228, such that fluid may flow through each of the first slot 224, the second slot 226, and the third slot 228, in the open position of the control valve 126.

The control sleeve 236 may include any suitable mechanism for selectively blocking flow through the plurality of slots 222. For example, as illustrated, the control sleeve 236 may include a tubular or other suitable tool disposed within the central bore 122. As set forth in greater detail below, the control sleeve 236 may be configured to move axially with respect to the central bore 122 between various axial positions in response to being driven by an actuation assembly 130 (e.g., an electrical actuation assembly, a hydraulic actuation assembly, a hydro-electrical actuation assembly). As illustrated, the control sleeve 236 may be axially offset (e.g., disposed uphole) from the at least one slot 220 (e.g., the first slot 224, the second slot 226, and the third slot 228) in the open position. However, as set forth in greater detail below, the control sleeve 236 may be actuated between various predetermined axial positions (e.g., the open position, first intermediate position, the second intermediate position, a closed position, etc.) corresponding to suitable positions for selectively blocking or allowing flow through each slot of the plurality of slots 222. As set forth above, each slot of the plurality of slots 222 may be axially offset from each other. Accordingly, to block flow into the slots corresponding to a predetermined axial position, the radially outer surface 274 of the control sleeve 236 may be configured to interface with a radially inner surface 268 the valve body 218 about the corresponding slots 220 to form at least a partial seal about the corresponding slots 220, which may block flow into the corresponding slots 220.

Moreover, the downhole valve assembly 104 may further include a ball valve 128 disposed within the central bore 122. In particular, the ball valve 128 may be disposed in the central bore in an axial position between the upper opening 210 and the lower opening 214. Further, the ball valve 128 may be configured to actuate between an open orientation to permit flow through the central bore 122 and a closed orientation to block flow through the central bore 122. In particular, the ball valve 128 may include a ball valve body 242 configured to seal against the inner surface 272 of the central bore 122. The ball valve body 242 may include a main bore 238 extending through the ball valve body 242. Further, the ball valve body 242 may be configured to rotate in response to being driven by the actuation assembly 130 (e.g., the electrical actuation assembly, the hydraulic actuation assembly, the hydro-electrical actuation assembly, etc.). Specifically, the ball valve body 242 may be configured to rotate between the open orientation and the closed orientation. In the open orientation, the main bore 238 may be aligned with the central bore 122 such that fluid flowing along the central bore 122 may pass through the ball valve 128 via the main bore 238. In the closed orientation, a surface portion 240 of the ball valve body 242 may be aligned with the central bore 122 to block fluid flow through the ball valve 128; thereby blocking fluid flow through the central bore 122. Indeed, the main bore 238 may be aligned with the control valve 126 such that fluid communication between the main bore 238 and the central bore 122 is blocked in the closed orientation.

As set forth above, the downhole valve assembly 104 may include an actuation assembly 130 configured to drive actuation of the control valve 126 and/or the ball valve 128 between the various positions and/or orientations for controlling fluid flow through the downhole tubular 106. The actuation assembly 130 may include any suitable actuation assembly. As illustrated, the actuation assembly 130 may include an electrical actuation assembly 248 configured to drive actuation of the control valve 126 and/or the ball valve 128. The electrical actuation assembly 248 may include at least one motor 244 and at least one actuator 246, which may be disposed within the downhole tubular 106 or in any suitable location for interfacing with the control valve 126 and/or the ball valve 128. During operation, the at least one motor 244 is configured to selectively drive the at least one actuator 246 in response to receiving actuation instructions. Further, the at least one actuator 246 is configured to drive the control valve 126 and/or the ball valve 128 to respective predetermined axial positions (e.g., the open position, the first intermediate position, the second intermediate position, the closed position, etc.) and orientations (e.g., the open orientation and the closed orientation) in response to actuation of the at least one motor 244.

For example, as illustrated, the at least one actuator 246 of the electrical actuation assembly 248 may include a first ball screw 250 and a second ball screw 252 each configured to move in response to actuation of a corresponding first motor 254 and a second motor 256. In particular, the first ball screw 250 may be configured to interface directly or indirectly with the first motor 254 and the control sleeve 236 of the control valve 126. In response to the interface between the first ball screw 250 and the control sleeve 236, movement of the first ball screw 250 may be configured to drive axial movement of the control sleeve 236 along the central bore 122 between the respective predetermined axial positions. Further, the second ball screw 252 may be configured to interface directly or indirectly with the second motor 256 and an interface mechanism 258 of the ball valve 128. The interface mechanism 258 may be configured to convert translational movement of the second ball screw 252 into rotational movement to drive rotation of the ball valve 128 between the open orientation and the closed orientation. Alternatively, or additionally, the at least one actuator 246 may include a linking member 264 (shown in FIG. 4) configured to rigidly secure the second motor 256 to the ball valve 128 such that rotation of the second motor 256 drives rotation of the ball valve 128. The electrical actuation assembly 248 may include any suitable components for actuating the control valve 126 and the ball valve 128.

Further, as set forth above, the surface control system 132 may be configured to output actuation instructions to the actuation assembly 130 (e.g., the electrical actuation assembly 248). The surface control system 132 (shown in FIG. 1) may include a user interface configured to receive user input. Based at least in part on the user input, the surface control system 132 may be configured to output the actuation instructions to the actuation assembly 130. The at least one motor 244 may be configured to actuate in response to receiving the actuation instructions from the surface control system 132. Alternatively, or additionally, the downhole control system 134 may be configured to output actuation instructions to the actuation assembly 130. The downhole control system 134 may include a downhole controller 260 and at least one downhole sensor 262 configured to measure at least one downhole parameter (e.g., temperature, pressure, flow rate, etc.). The controller may be configured to receive sensor data from the at least one downhole sensor 262. Based at least in part on the sensor data, the downhole controller 260 may be configured to automatically determine actuation instructions for the actuation assembly 130. For example, the downhole control system 134 may be configured to output actuation instructions for actuating the control valve 126 and/or the ball valve 128 in response to determining, via the sensor data, that a measured downhole parameter exceeds a predetermined threshold value.

Moreover, as set forth above, the downhole valve assembly 104 may be configured to actuate both the control valve 126 and the ball valve 128, via the actuation assembly 130, to various positions and orientations to provide variable control of fluid flow through the downhole tubular 106 during operations. For example, the control valve 126 and the ball valve 128 may be configured to actuate to corresponding positions and/or orientations to control the fluid flow such that fluid flows through the downhole tubular 106 in a blocked flow state, open flow state, and at least one choked state (e.g. a fully choked state, a first partially choked state, a second partially choked state, etc.) As illustrated, the downhole valve assembly 104 may be in a partially choked state (e.g., the first partially choked state). That is, the control valve 126 and the ball valve 128 of the downhole valve assembly 104 may be positioned and oriented such that fluid flows through the downhole tubular 106 in the first partially choked state. In the first partially choked state, the control valve 126 is actuated to the open position and the ball valve 128 is actuated to the closed orientation to block fluid flow through the central bore 122 and permit fluid flow through the bypass flow path 202.

Figure 3:
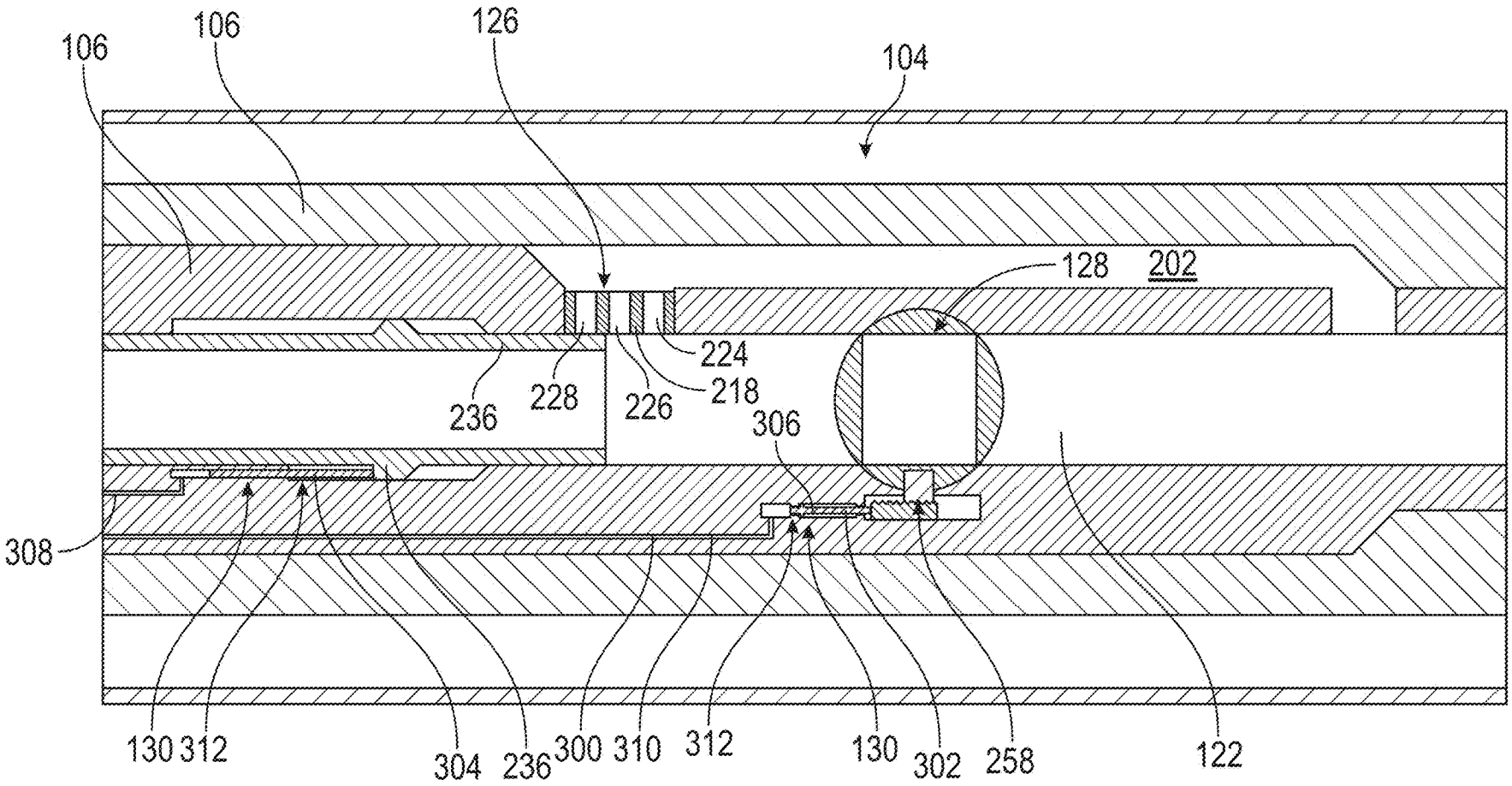
FIG. 3 illustrates a cross-sectional view of a downhole valve assembly in a second partially choked state, in accordance with some embodiments of the present disclosure.

FIG. 3 illustrates a cross-sectional view of a downhole valve assembly in a second partially choked state, in accordance with some embodiments of the present disclosure. As set forth above, the downhole valve assembly 104 may include the control valve 126 configured to control flow through the bypass flow path 202 and the ball valve 128 configured to control flow through the central bore 122 of the downhole tubular 106. Further, as set forth above, the downhole valve assembly 104 may be configured to actuate both the control valve 126 and the ball valve 128, via the actuation assembly 130, to various positions and orientations to provide interventionless and variable control of the fluid flow such that fluid flows through the downhole tubular 106 in the blocked flow state, the open flow state, and at least one choked state (e.g. the fully choked state, the first partially choked state, the second partially choked state, etc.) without running in hole a downhole tool such as a mechanical plug.

As illustrated, the downhole valve assembly 104 may be in the second partially choked state. That is, the control valve 126 and the ball valve 128 of the downhole valve assembly 104 may be positioned and oriented such that fluid flows through the downhole tubular 106 in the second partially choked state. In the second partially choked state, the control valve 126 is actuated to an intermediate position (e.g., a second intermediate position) and the ball valve 128 is actuated to the closed orientation such that fluid flow is blocked through the central bore 122 and a reduced portion of flow is permitted through the bypass flow path 202.

In the second intermediate position, the control sleeve 236 may be axially positioned to block fluid flow through the bypass flow path 202 via the third slot 228 but permit fluid flow through the bypass flow path 202 via the first slot 224 and second slot 226. That is, the control sleeve 236 may be axially offset from the first slot 224 and the second slot 226 but axially aligned with the third slot 228. Specifically, the control sleeve 236 may be axially positioned to interface with the valve body 218 about the third slot 228, such that the interface between the control sleeve 236 and the valve body 218 restrain fluid flow into the third slot 228. Accordingly, in the second partially choked state, the flow rate through bypass flow path 202 may be lower than the first partially choked state since fluid may also flow through the third slot 228 in the first partially choked state.

Moreover, as set forth above, the downhole valve assembly 104 may include the actuation assembly 130 configured to drive actuation of the control valve 126 and/or the ball valve 128 between the various positions and/or orientations for controlling fluid flow through the downhole tubular 106. The actuation assembly may include any suitable actuation assembly. For example, as illustrated, the actuation assembly 130 may include a hydraulic actuation assembly 312 configured to drive actuation of the control valve 126 and/or the ball valve 128. The hydraulic actuation assembly 312 may include at least one control line 300 and at least one piston 302. During operation, pressure in the at least one control line 300 may be raised above a threshold pressure to drive movement of the at least one piston 302. Further, the at least one piston 302 may be configured to interface with the control valve 126 and/or the ball valve 128 such that movement of the at least one piston 302 may drive the control valve 126 and/or the ball valve 128 to respective predetermined axial positions (e.g., the open position, the first intermediate position, the second intermediate position, the closed position, etc.) and orientations (e.g., the open orientation and the closed orientation).

For example, as illustrated, a hydraulic actuation assembly 312 may include a first piston 304 and a second piston 306 each configured to move in response to hydraulic pressure in a corresponding first control line 308 and a second control line 310. In particular, the first piston 304 may be configured to interface directly or indirectly with the control sleeve 236 of the control valve 126. In response to the interface between the first piston 304 and the control sleeve 236, movement of the first piston 304 may be configured to drive axial movement of the control sleeve 236 along the central bore 122 between the respective predetermined axial positions. For example, the first piston 304 may be configured to move to drive the control sleeve 236 to the first intermediate position in response to pressure in the first control line 308 exceeding a first threshold pressure, move to drive the control sleeve 236 to the second intermediate position in response to pressure in the first control line 308 exceeding a second threshold pressure, and drive the control sleeve 236 to the closed position in response to pressure in the first control line 308 exceeding a third threshold pressure. As illustrated, the pressure in the first control line 308 may be held between the second threshold pressure and the third threshold pressure such that the first piston 304 drives the control sleeve 236 to the second intermediate position. Additionally, the holding the pressure in the first control line 308 below the first threshold pressure may be configured to drive the control sleeve 236 to the open position.

Further, the second piston 306 may be configured to interface directly or indirectly with the interface mechanism 258 of the ball valve 128 such that movement of the second piston 306 may drive rotation of the ball valve 128 between the open orientation and the closed orientation. For example, as illustrated, the second piston 306 may be configured to drive rotation of the ball valve 128 to the closed orientation in response to pressure in the second control line 310 exceeding a first ball valve actuation pressure. Reducing the pressure in the second control line 310 below the first ball valve actuation pressure may be configured to drive rotation of the ball valve 128 to the open orientation. The hydraulic actuation assembly 312 may include any suitable components for actuating the control valve 126 and the ball valve 128.

Figure 4:
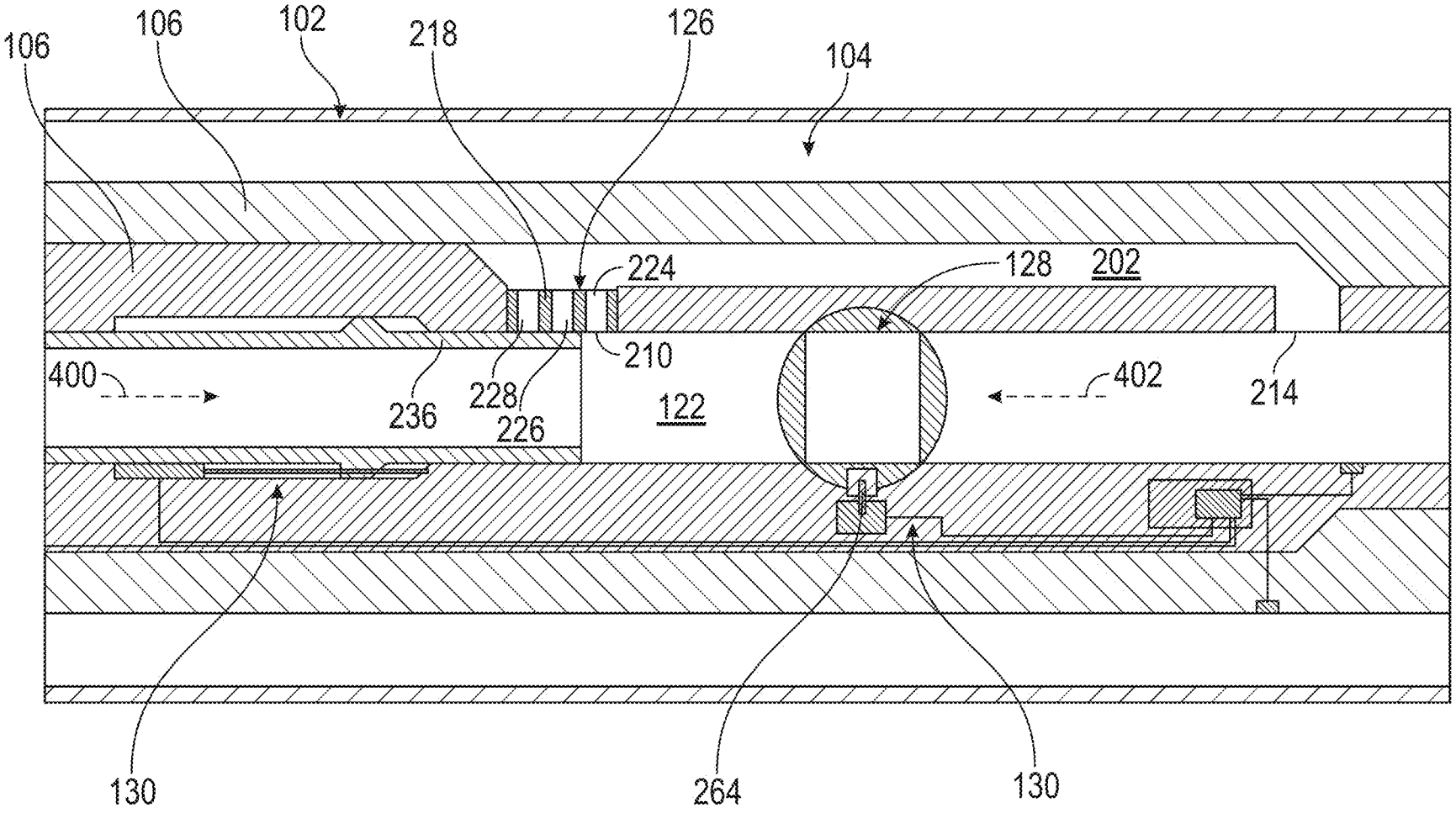
FIG. 4 illustrates a cross-sectional view of a downhole valve assembly in a fully choked state, in accordance with some embodiments of the present disclosure.

FIG. 4 illustrates a cross-sectional view of a downhole valve assembly in a fully choked state, in accordance with some embodiments of the present disclosure. As set forth above, the downhole valve assembly 104 may include the control valve 126 configured to control flow through the bypass flow path 202 and the ball valve 128 configured to control flow through the central bore 122 of the downhole tubular 106. Further, as set forth above, the downhole valve assembly 104 may be configured to actuate both the control valve 126 and the ball valve 128, via the actuation assembly 130, to various positions and orientations to provide variable control of the fluid flow such that fluid flows through the downhole tubular 106 in the blocked flow state, the open flow state, and at least one choked state (e.g. the fully choked state, the first partially choked state, the second partially choked state, etc.)

As illustrated, the downhole tubular 106 may be in the fully choked state. That is, the control valve 126 and the ball valve 128 of the downhole valve assembly may be positioned and oriented such that fluid flows through the downhole tubular 106 in the fully choked state. In the fully choked state, the control valve 126 is actuated to the intermediate position (e.g., the first intermediate position) and the ball valve 128 is actuated to the closed orientation such that fluid flow is blocked through the central bore 122 and a further reduced portion of flow is permitted through the bypass flow path 202.

In the first intermediate position, the control sleeve 236 may be axially positioned to block fluid flow through the bypass flow path 202 via the second slot 226 and the third slot 228 but permit fluid flow through the bypass flow path 202 via the first slot 224. That is, the control sleeve 236 may be axially offset from the first but axially aligned with the second slot 226 and the third slot 228. Specifically, the control sleeve 236 may be axially positioned to interface with the valve body 218 about the second slot 226 and the third slot 228, such that the interface between the control sleeve 236 and the valve body 218 restrain fluid flow through the second slot 226 and the third slot 228. Accordingly, in the fully choked state, the flow rate through bypass flow path 202 may be lower than the first partially choked state and the second partially choked state since fluid may only flow through the first slot 224 and fluid flow through the bypass flow path 202 via any remaining slots (e.g., the second slot 226 and the third slot 228) is blocked in the fully choked state.

Moreover, as set forth above, the bypass flow path 202 may be in fluid communication with the central bore 122 via the upper opening 210 and the lower opening 214. During operations, fluid may be injected into the wellbore 102. In some control valve positions (e.g., the open position, the first intermediate position, the second intermediate position, etc.), the fluid injected into the wellbore 102 may be configured to flow into the downhole tubular 106 and through the bypass flow path 202 in a downhole direction 400. In particular, fluid may be configured to flow through the upper opening 210 and into the bypass flow path 202, via the control valve 126. Further, the fluid may flow through the bypass flow path 202 from the upper opening 210 toward the lower opening 214 and re-enter the central bore 122 of the downhole tubular 106 via the lower opening 214. As set forth above, the lower opening 214 may be positioned downhole the ball valve 128 such that the fluid flowing through the bypass flow path 202 may bypass the ball valve 128.

Alternatively, or additionally, fluid produced by the wellbore 102 may be configured to flow from a corresponding production zone (shown in FIG. 1) toward the surface. Along at least a portion of the wellbore 102, the fluid may be configured to move through the downhole tubular 106. In some control valve positions (e.g., the open position, the first intermediate position, the second intermediate position, etc.), the fluid produced by the wellbore 102 may be configured to flow into the downhole tubular 106 and through the bypass flow path 202 in an uphole direction 402. In particular, fluid may be configured to flow through the lower opening 214 and into the bypass flow path 202. Further, the fluid may flow through the bypass flow path 202 from the lower opening 214 toward the upper opening 210 and re-enter the central bore 122 of the downhole tubular 106 via the upper opening 210. As set forth above, the upper opening 210 may be positioned uphole from the ball valve 128 and the lower opening 214 may be positioned downhole from the ball valve 128 such that the fluid flowing through the bypass flow path 202 may bypass the ball valve 128.

Figure 5:
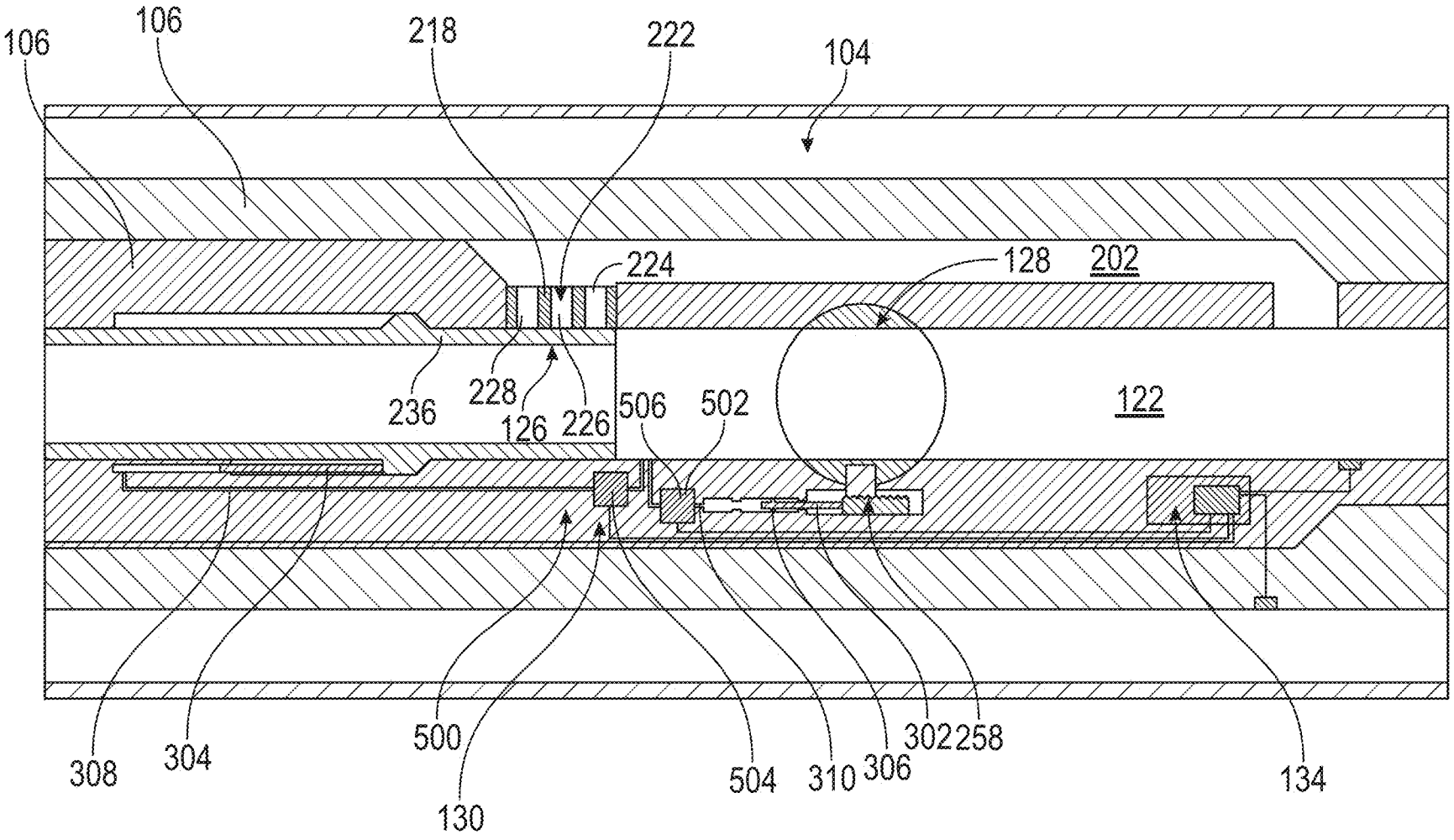
FIG. 5 illustrates a cross-sectional view of a downhole valve assembly in an open flow state, in accordance with some embodiments of the present disclosure.

FIG. 5 illustrates a cross-sectional view of a downhole valve assembly in an open flow state, in accordance with some embodiments of the present disclosure. As set forth above, the downhole valve assembly 104 may include the control valve 126 configured to control flow through the bypass flow path 202 and the ball valve 128 configured to control flow through the central bore 122 of the downhole tubular 106. Further, as set forth above, the downhole valve assembly 104 may be configured to actuate both the control valve 126 and the ball valve 128, via the actuation assembly 130, to various positions and orientations to provide variable control of the fluid flow such that fluid flows through the downhole tubular 106 in the blocked flow state, the open flow state, and at least one choked state (e.g. the fully choked state, the first partially choked state, the second partially choked state, etc.)

As illustrated, the downhole valve assembly 104 may be in the open flow state. That is, the control valve 126 and the ball valve 128 of the downhole valve assembly 104 may be positioned and oriented such that fluid flows through the downhole tubular 106 in the open flow state. In the open flow state, the control valve 126 is actuated to the closed position and the ball valve 128 is actuated to the open orientation such that fluid flow is permitted through the central bore 122 and blocked through the bypass flow path 202.

In the closed position of the control valve 126, the control sleeve 236 may be axially positioned to block fluid flow through the bypass flow path 202 via all slots of the plurality of slots 222. For example, as illustrated, the control sleeve 236 may be configured to block fluid flow through each of the first slot 224, the second slot 226, and the third slot 228. Specifically, the control sleeve 236 may be axially positioned to interface with the valve body 218 such that the interface between the control sleeve 236 and the valve body 218 restrain fluid flow through the first slot 224, the second slot 226, and the third slot 228. Accordingly, in the closed position of the control valve 126, fluid flow through bypass flow path 202 may be blocked. Further, the fluid flowing through the downhole tubular 106 may flow through the central bore 122. As set forth above, the central bore 122 may be larger than the bypass flow path 202 such that the flow rate through the downhole tubular 106 in the open flow state may be higher than the flow rate through the downhole tubular 106 in the first partially choked state, the second partially choked state, the fully choked state, or any other suitable state directing flow through the bypass flow path 202 instead of through the central bore 122.

Moreover, as set forth above, the downhole valve assembly 104 may include the actuation assembly 130 configured to drive actuation of the control valve 126 and/or the ball valve 128 between the various positions and/or orientations for controlling fluid flow through the downhole tubular 106. The actuation assembly 130 may include any suitable actuation assembly. For example, as illustrated, the actuation assembly may include an electro-hydraulic actuation assembly 500 configured to drive actuation of the control valve 126 and/or the ball valve 128. The electro-hydraulic actuation assembly 500 includes at least one pump 502 configured to actuate in response to receiving actuation instructions. The at least one pump 502 may be configured to drive the at least one piston 302 to actuate the control valve 126 and/or the ball valve 128 to respective predetermined axial positions (e.g., the open position, the first intermediate position, the second intermediate position, the closed position, etc.) and orientations (e.g., the open orientation and the closed orientation)

For example, the electro-hydraulic actuation assembly 500 may include the first piston 304 and the second piston 306 each configured to move in response to hydraulic pressure in the corresponding first control line 308 and the second control line 310. In particular, the first piston 304 may be configured to interface directly or indirectly with the control sleeve 236 of the control valve 126. In response to the interface between the first piston 304 and the control sleeve 236, movement of the first piston 304 may be configured to drive axial movement of the control sleeve 236 along the central bore 122 between the respective predetermined axial positions. For example, the first piston 304 may be configured to move to drive the control sleeve 236 to the first intermediate position in response to pressure in the first control line 308 exceeding a first threshold pressure, move to drive the control sleeve 236 to the second intermediate position in response to pressure in the first control line 308 exceeding a second threshold pressure, and drive the control sleeve 236 to the closed position in response to pressure in the first control line 308 exceeding a third threshold pressure. As illustrated, the pressure in the first control line 308 may be held above the third threshold pressure such that the first piston 304 drives the control sleeve to the closed position. Additionally, the holding the pressure in the first control line 308 below the first threshold pressure may be configured to drive the control sleeve 236 to the open position.

Further, the second piston 306 may be configured to interface directly or indirectly with the interface mechanism 258 of the ball valve 128 such that movement of the second piston 306 may drive rotation of the ball valve 128 between the open orientation and the closed orientation. For example, as illustrated, the second piston 306 may be configured to drive rotation of the ball valve 128 to the closed orientation in response to pressure in the second control line 310 exceeding a first ball valve actuation pressure. Reducing the pressure in the second control line 310 below the first ball valve actuation pressure may be configured to drive rotation of the ball valve 128 to the open orientation.

The electro-hydraulic actuation assembly may also include a first pump 504 and a second pump 506. The first pump 504 may be in fluid communication with the first control line 308 and the second pump 506 may be in fluid communication with the second control line 310. In response to receiving actuation instructions, the first pump 504 and the second pump 506 may each be configured to actuate to control the pressure in the first control line 308 and the second control line 310, respectively. For example, as illustrated, the first pump 504 may be configured to actuate to raise the pressure in the first control line 308 above the third threshold pressure and the second pump 506 may be configured to reduce pressure in the second control line 310 below the first ball valve actuation pressure to drive rotation of the ball valve 128 to the open orientation. Further, the first pump 504 and the second pump 506 may be configured to receive actuation instruction from the surface control system 132, the downhole control system 134, or any suitable system via any suitable communication system.

Figure 6:
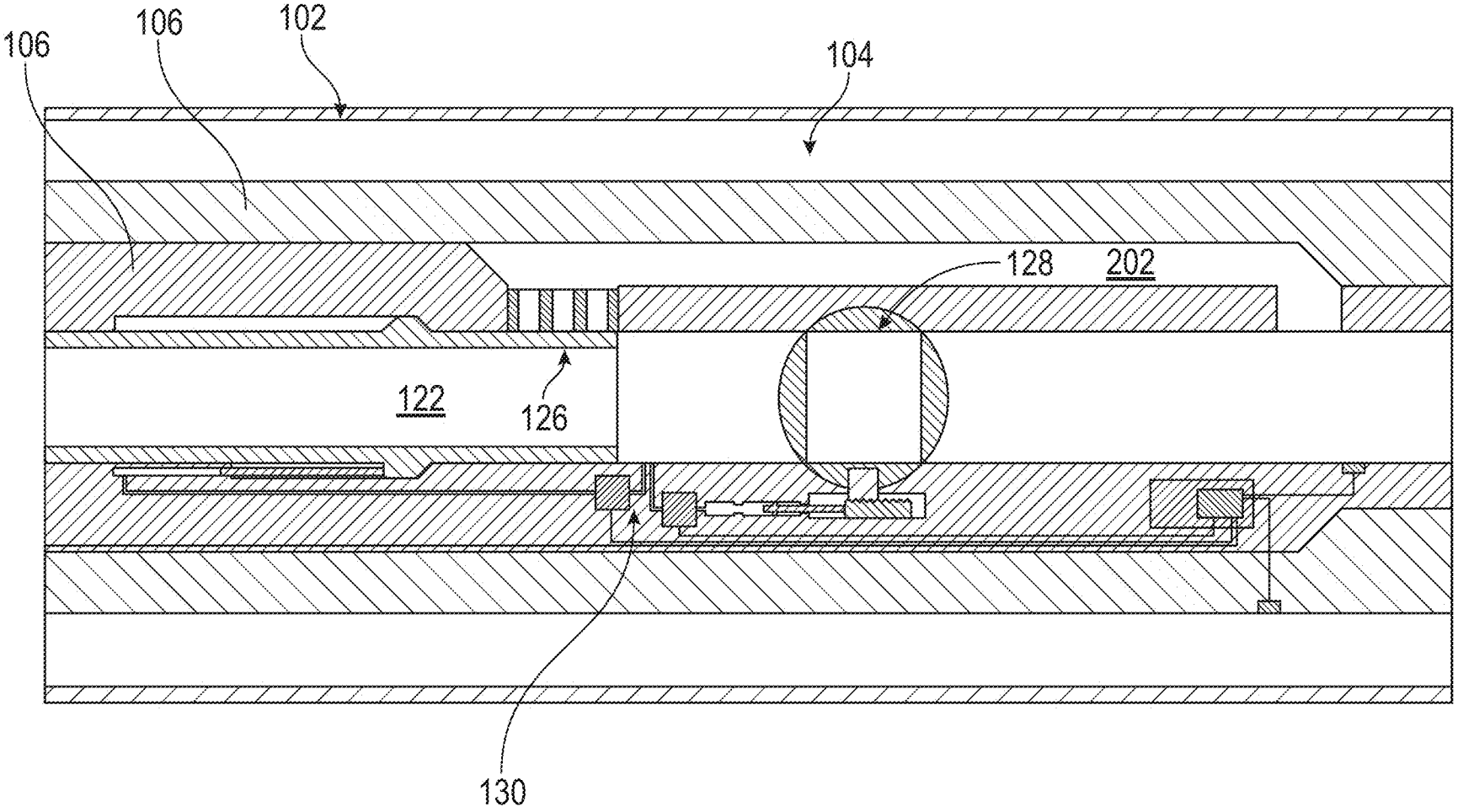
FIG. 6 illustrates a cross-sectional view of a downhole valve assembly in a blocked flow state, in accordance with some embodiments of the present disclosure.

FIG. 6 illustrates a cross-sectional view of a downhole valve assembly in a blocked flow state, in accordance with some embodiments of the present disclosure. As set forth above, the downhole valve assembly 104 may include the control valve 126 configured to control flow through the bypass flow path 202 and the ball valve 128 configured to control flow through the central bore 122 of the downhole tubular 106. Further, as set forth above, the downhole valve assembly 104 may be configured to actuate both the control valve 126 and the ball valve 128, via the actuation assembly 130, to various positions and orientations to provide variable control of the fluid flow such that fluid may flow through the downhole tubular 106 in the blocked flow state, the open flow state, and at least one choked state (e.g. the fully choked state, the first partially choked state, the second partially choked state, etc.)

As illustrated, the downhole valve assembly 104 may be in the blocked flow state. That is, the control valve 126 and the ball valve 128 of the downhole valve assembly may be positioned and oriented such that fluid is blocked from flowing through the downhole tubular 106. In the blocked flow state, the control valve 126 is actuated to the closed position and the ball valve 128 is actuated to the closed orientation such that fluid flow is blocked through both the central bore 122 and the bypass flow path 202. Blocking fluid flow through the downhole tubular 106 may allow operators to isolate portions of the wellbore 102 during operations.

Figure 7C:
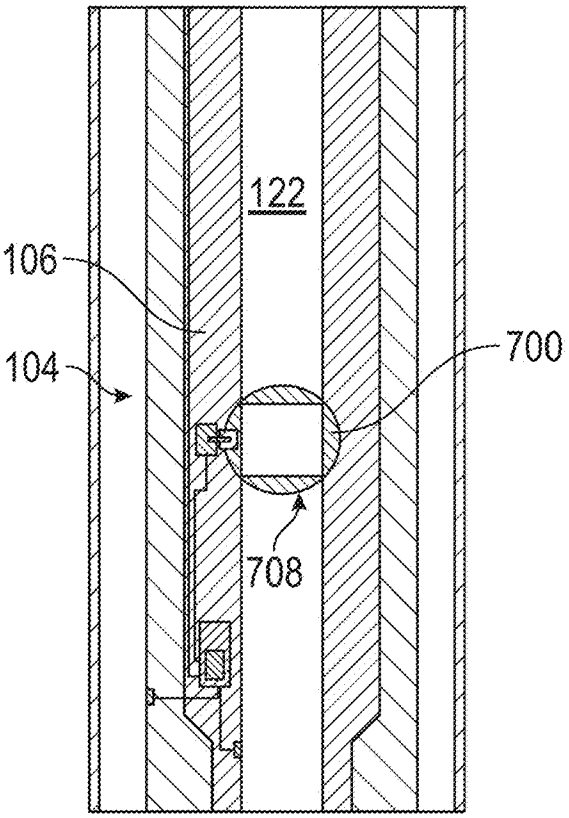
FIGS. 7A-C illustrate respective cross-sectional views of a downhole valve assembly having a slotted ball valve, in accordance with some embodiments of the present disclosure.
Figure 7B:
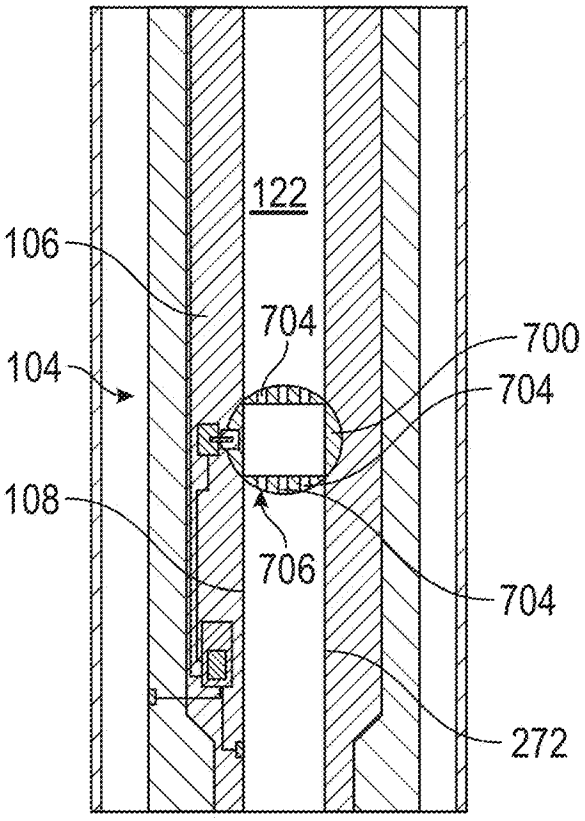
Figure 7A:
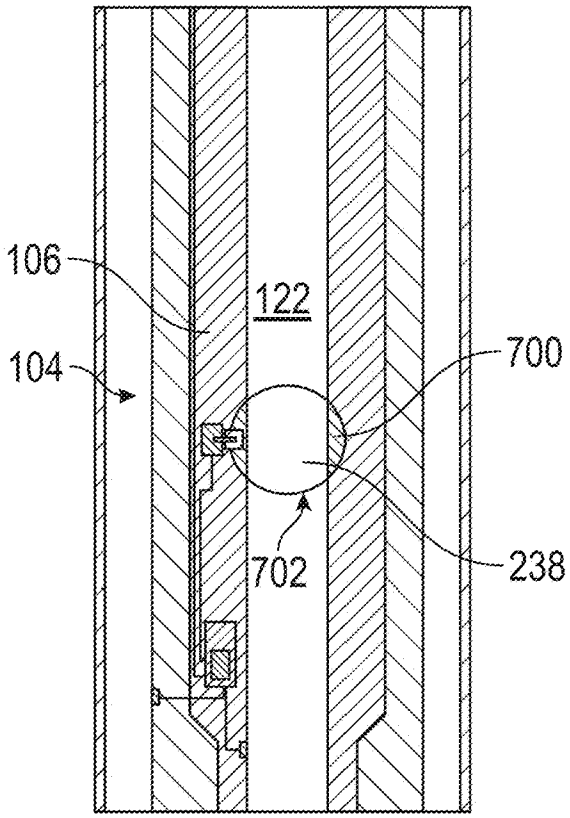

FIGS. 7A-C illustrate respective cross-sectional views of a downhole valve assembly having a slotted ball valve, in accordance with some embodiments of the present disclosure. As set forth above, the downhole valve assembly 104 may be configured to actuate the control valve 126 and the ball valve 128, via the actuation assembly, to various positions and orientations to control fluid flow through the downhole tubular during operations (shown in FIGS. 2-6). Alternatively, as illustrated, the downhole valve assembly 104 may include the slotted ball valve 700 to provide variable control of fluid flow through the downhole tubular 106 during operations. To provide variable control of the fluid flow through the central bore 122, the slotted ball valve 700 may be configured to rotate between the open orientation, the closed orientation, as well as a partially open orientation.

As shown in FIG. 7A, the slotted ball valve 700 may be disposed in the open orientation. As illustrated, the main bore 238 may extend through a first portion 702 of the slotted ball valve 700. In the open orientation, the slotted ball valve 700 may be rotated to align the main bore 238 with the central bore 122 such that fluid may flow through the slotted ball valve 700 in the open flow state.

As shown in FIG. 7B, the slotted ball valve 700 may be disposed in the partially open orientation. As illustrated, at least one ball slot 704 may extend through a second portion 706 of the slotted ball valve 700. In the partially open orientation, the slotted ball valve 700 may be rotated to align the at least one ball slot 704 with the central bore 122 such that that fluid may flow through the slotted ball valve 700 in the partially choked state. Further, the main bore 238 may be rotated such that fluid communication between the central bore 122 and the main bore 238 is blocked in the partially open orientation. For example, the main bore 238 may be aligned with the inner surface 272 of the central bore 122 in the partially open orientation.

Moreover, the at least one ball slot 704 may be smaller than the main bore 238. That is, a cross-sectional area of the at least one ball slot 704 may be smaller than the main bore 238 such that the flow rate through the slotted ball valve 700 is higher in the open orientation (e.g., open flow state) than in the partially open orientation (e.g., the partially choked state). Further, the at least one ball slot 704 may be circumferentially offset from the main bore 238 such that the slotted ball valve 700 may be indexed between the open orientation and the partially open orientation via rotation of the slotted ball valve 700.

As shown in FIG. 7C, the slotted ball valve 700 may be disposed in the closed orientation. In the closed orientation, the slotted ball valve 700 may be rotated to align a third portion 708 of the slotted ball valve 700 with the central bore 122. As illustrated, the third portion 708 of the slotted ball valve 700 may not include a fluid path through the slotted ball valve 700 such that aligning the third portion 708 of the slotted ball valve 700 with the central bore 122 may block fluid flow through the slotted ball valve 700; thereby blocking fluid flow through the central bore 122. Further, the third portion 708 may be circumferentially offset from the first portion 702 (e.g., the main bore 238) and the second portion 706 (e.g., the at least one ball slot 704) such that the slotted ball valve 700 may be indexed between the closed orientation, the open orientation, and the partially open orientation via rotation of the slotted ball valve 700.

Accordingly, the present disclosure may provide systems and methods for a downhole valve assembly configured to provide variable control of fluid flow through a downhole tubular during production and/or injection operations. The systems and methods may include any of the various features disclosed herein, including one or more of the following statements.

Statement 1. A downhole valve system, comprising: a downhole tubular having body portion and a central bore extending axially through the body portion, wherein production fluid is configured to flow along the central bore; a bypass flow path extending axially through the downhole tubular, wherein the bypass flow path is in fluid communication with the central bore via an upper opening and a lower opening axially offset from the upper opening; a control valve disposed along the bypass flow path to control flow along the bypass flow path, wherein the control valve is configured to actuate between an open position and closed position to control the flow; and a ball valve disposed within the central bore in an axial position between the upper opening and the lower opening, wherein the ball valve is configured to actuate between an open orientation to permit flow through the central bore and a closed orientation to block flow through the central bore.

Statement 2. The downhole valve system of statement 1, wherein the control valve includes at least one slot configured to direct fluid flow through the control valve, and wherein the control valve includes a control sleeve configured to move axially with respect to the central bore, wherein the control sleeve is configured to move between the open position with the control sleeve axially offset from the at least one slot to permit fluid flow through the at least one slot and the closed position with the control sleeve axially aligned with the at least one slot to block fluid flow through the at least one slot.

Statement 3. The downhole valve system of statement 1 or statement 2, wherein the at least one slot includes a first slot and a second slot, and wherein the first slot has a different size and/or shape than the second slot.

Statement 4. The downhole valve system of any preceding statement, wherein the at least one slot includes a first slot and a second slot, and wherein the first slot is axially offset from the second slot.

Statement 5. The downhole valve system of any preceding statement, wherein the control sleeve is configured to further move to an intermediate position, wherein the control sleeve is axially aligned with the first slot and axially offset from the second slot in the intermediate position such that fluid is permitted to flow through the first slot and blocked from flowing through the second slot, and wherein the control sleeve is configured to move to block fluid flow through both the first slot and the second slot in the closed position.

Statement 6. The downhole valve system of any preceding statement, wherein the control valve and the ball valve are configured to actuate to control fluid flow through the downhole tubular in a fully choked state, wherein the control valve is actuated to the intermediate position and the ball valve is actuated to the closed orientation in the fully choked state to block fluid through the central bore, permit fluid flow through the bypass flow path via the first slot, and block fluid flow through the bypass flow path via the second slot.

Statement 7. The downhole valve system of any preceding statement, wherein the control valve and the ball valve are configured to actuate to control fluid flow through the downhole tubular in a blocked flow state, open flow state, and a partially choked state, wherein the control valve is actuated to the closed position and the ball valve is actuated to the closed orientation in the blocked flow state to block fluid flow through the downhole tubular, wherein the control valve is actuated to the closed position and the ball valve is actuated to the open orientation in the open flow state to permit fluid flow through the central bore, and wherein the control valve is actuated to the open position and the ball valve is actuated to the closed orientation in the partially choked state to block fluid flow through the central bore and permit fluid flow through the bypass flow path.

Statement 8. The downhole valve system of any preceding statement, wherein a cross-sectional area of the bypass flow path is smaller than a cross-section area of the central bore such that blocking flow through the central bore and directing flow through the bypass flow path at least partially chokes flow through the downhole tubular.

Statement 9. The downhole valve system of any preceding statement, wherein the ball valve includes a body portion and a main bore extending through the body portion, wherein the ball valve is configured to align the main bore with the central bore in the open orientation to permit flow through the central bore and align the body portion with the central bore in the closed orientation to block flow through the central bore.

Statement 10. The downhole valve system of any preceding statement, further comprising an electrical actuation assembly configured to drive actuation of the control valve and/or the ball valve, wherein the electrical actuation assembly includes a motor and an actuator driven by the motor, wherein the actuator is configured to drive the control valve and/or the ball valve to actuate in response to actuation of the motor.

Statement 11. The downhole valve system of any preceding statement, further comprising a surface control system, wherein the surface control system is configured to output actuation instructions, and wherein the motor is configured to actuate in response to receiving the actuation instructions from the surface control system.

Statement 12. The downhole valve system of any preceding statement, further comprising at least one downhole sensor and a downhole control system, wherein the downhole control system is configured to receive sensor date from the at least one downhole sensor, wherein the downhole control system is configured to output actuation instructions for actuating the control valve and/or the ball valve in response to determining, via sensor data, that a downhole parameter exceeds a predetermined threshold.

Statement 13. The downhole valve system of any preceding statement, further comprising a hydraulic actuation assembly configured to drive actuation of the control valve and/or the ball valve, wherein the hydraulic actuation assembly includes at least one piston configured to drive the control valve and/or the ball valve to actuate in response to hydraulic pressure in the hydraulic actuation assembly exceeding a threshold actuation pressure.

Statement 14. The downhole valve system of any preceding statement, further comprising an electro-hydraulic actuation assembly configured to drive actuation of the control valve and/or the ball valve, wherein the electro-hydraulic actuation assembly includes at least one pump configured to actuate in response to receiving instructions from a controller, wherein the pump is configured to drive at least one piston to actuate the control valve and/or the ball valve.

Statement 15. The downhole valve system of any preceding statement, wherein the upper opening is configured to receive the fluid from the central bore, from a position uphole the ball valve, in response to fluid being injected into the downhole tubular from surface and the control valve being in the open position or an intermediate position, and wherein the lower opening is configured to output the fluid into the central bore to a position downhole the ball valve.

Statement 16. The downhole valve system of any of statements 1-14, wherein the lower opening is configured to receive the production fluid from the central bore, from a position downhole the ball valve, in response to fluid flowing uphole through the downhole tubular and the control valve being in the open position or an intermediate position, and wherein the upper opening is configured to output the fluid into the central bore to a position uphole the ball valve.

Statement 17. The downhole valve system of any preceding statement, wherein the ball valve includes a main bore extending through a first portion of the ball valve and at least one ball slot extending through a second portion of the ball valve, wherein the ball valve is configured to rotate to align the main bore with the central bore in the open orientation, and wherein the ball valve is configured to rotate to align the at least one ball slot with the central bore in a partially open orientation.

Statement 18. A downhole valve system, comprising: a downhole tubular having body portion and a central bore extending axially through the body portion, wherein fluid is configured to flow along the central bore; a bypass flow path extending axially through the downhole tubular, wherein the bypass flow path is in fluid communication with the central bore via an upper opening and a lower opening axially offset from the upper opening; a control valve configured to control flow along the bypass flow path, wherein the control valve is configured to actuate between an open position, an intermediate position, and closed position to control the flow, wherein the control valve comprises: a valve body disposed along the bypass flow path; a first slot extending through the valve body; a second slot extending through the valve body, wherein the second slot is axially offset from the first slot; and a control sleeve disposed within the central bore and configured to interface with the valve body as the control sleeve moves axially between the open position, the intermediate position, and the closed position, wherein the control sleeve is axially offset from the first slot and the second slot in the open position, wherein the control sleeve is axially aligned with the first slot and axially offset from the second slot in the intermediate position to permit flow through the first slot and block from flowing through the second slot, and wherein the control sleeve is axially aligned with the first slot and the second slot in the closed position to block flow through the first slot and the second slot; and a ball valve disposed within the central bore in an axial position between the upper opening and the lower opening, wherein the ball valve is configured to rotate between an open orientation to permit flow through the central bore and a closed orientation to block flow through the central bore, wherein the ball valve comprises: a body portion; and a main bore extending through the body portion, wherein the main bore is aligned with the central bore in the open orientation to permit flow through the ball valve, and wherein the main bore is aligned with a surface of the central bore to block flow through the main bore in the closed orientation.

Statement 19. The downhole valve system of statement 18, wherein the control valve is disposed at the upper opening to control flow between the central bore and the bypass flow path via the upper opening.

Statement 20. A downhole valve system, comprising a downhole tubular having body portion and a central bore extending axially through the body portion, wherein production fluid is configured to flow along the central bore; a ball valve disposed within the central bore, wherein the ball valve is configured to rotate between an open orientation, a partially open orientation, and a closed orientation to control the flow through the central bore; a main bore extending through a first portion of the ball valve, wherein the ball valve is configured to rotate to align the main bore with the central bore in the open orientation; and at least one ball slot extending through a second portion of the ball valve, wherein the at least one ball slot is smaller than the main bore, and wherein the ball valve is configured to rotate to align the at least one ball slot with the central bore in the partially open orientation.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole valve system, comprising:

a downhole tubular having body portion and a central bore extending axially through the body portion, wherein production fluid is configured to flow along the central bore;

a bypass flow path extending axially through the downhole tubular, wherein the bypass flow path is in fluid communication with the central bore via an upper opening and a lower opening axially offset from the upper opening;

a control valve disposed along the bypass flow path to control flow along the bypass flow path, wherein the control valve is configured to actuate between an open position and closed position to control the flow; and a ball valve disposed within the central bore in an axial position between the upper opening and the lower opening, wherein the ball valve is configured to actuate between an open orientation to permit flow through the central bore and a closed orientation to block flow through the central bore, and wherein the control valve and the ball valve are configured to actuate to control fluid flow through the downhole tubular in a blocked flow state, an open flow state, and a partially choked state, wherein the control valve is actuated to the closed position and the ball valve is actuated to the closed orientation in the blocked flow state to block fluid flow through the downhole tubular, wherein the control valve is actuated to the closed position and the ball valve is actuated to the open orientation in the open flow state to permit fluid flow through the central bore, and wherein the control valve is actuated to the open position and the ball valve is actuated to the closed orientation in the partially choked state to block fluid flow through the central bore and permit fluid flow through the bypass flow path.

2. The downhole valve system of claim 1, wherein the control valve includes at least one slot configured to direct fluid flow through the control valve, and wherein the control valve includes a control sleeve configured to move axially with respect to the central bore, wherein the control sleeve is configured to move between the open position with the control sleeve axially offset from the at least one slot to permit fluid flow through the at least one slot and the closed position with the control sleeve axially aligned with the at least one slot to block fluid flow through the at least one slot.

3. The downhole valve system of claim 2, wherein the at least one slot includes a first slot and a second slot, and wherein the first slot has a different size and/or shape than the second slot.

4. The downhole valve system of claim 2, wherein the at least one slot includes a first slot and a second slot, and wherein the first slot is axially offset from the second slot.

5. The downhole valve system of claim 4, wherein the control sleeve is configured to further move to an intermediate position, wherein the control sleeve is axially aligned with the first slot and axially offset from the second slot in the intermediate position such that fluid is permitted to flow through the first slot and blocked from flowing through the second slot, and wherein the control sleeve is configured to move to block fluid flow through both the first slot and the second slot in the closed position.

6. The downhole valve system of claim 5, wherein the control valve and the ball valve are configured to actuate to control fluid flow through the downhole tubular in a fully choked state, wherein the control valve is actuated to the intermediate position and the ball valve is actuated to the closed orientation in the fully choked state to block fluid through the central bore, permit fluid flow through the bypass flow path via the first slot, and block fluid flow through the bypass flow path via the second slot.

7. The downhole valve system of claim 1, wherein a cross-sectional area of the bypass flow path is smaller than a cross-section area of the central bore such that blocking flow through the central bore and directing flow through the bypass flow path at least partially chokes flow through the downhole tubular.

8. The downhole valve system of claim 1, wherein the ball valve includes a body portion and a main bore extending through the body portion, wherein the ball valve is configured to align the main bore with the central bore in the open orientation to permit flow through the central bore and align the body portion with the central bore in the closed orientation to block flow through the central bore.

9. The downhole valve system of claim 1, further comprising an electrical actuation assembly configured to drive actuation of the control valve and/or the ball valve, wherein the electrical actuation assembly includes a motor and an actuator driven by the motor, wherein the actuator is configured to drive the control valve and/or the ball valve to actuate in response to actuation of the motor.

10. The downhole valve system of claim 9, further comprising a surface control system, wherein the surface control system is configured to output actuation instructions, and wherein the motor is configured to actuate in response to receiving the actuation instructions from the surface control system.

11. The downhole valve system of claim 1, further comprising at least one downhole sensor and a downhole control system, wherein the downhole control system is configured to receive sensor data from the at least one downhole sensor, wherein the downhole control system is configured to output actuation instructions for actuating the control valve and/or the ball valve in response to determining, via sensor data, that a downhole parameter exceeds a predetermined threshold.

12. The downhole valve system of claim 1, further comprising a hydraulic actuation assembly configured to drive actuation of the control valve and/or the ball valve, wherein the hydraulic actuation assembly includes at least one piston configured to drive the control valve and/or the ball valve to actuate in response to hydraulic pressure in the hydraulic actuation assembly exceeding a threshold actuation pressure.

13. The downhole valve system of claim 1, further comprising an electro-hydraulic actuation assembly configured to drive actuation of the control valve and/or the ball valve, wherein the electro-hydraulic actuation assembly includes at least one pump configured to actuate in response to receiving instructions from a controller, wherein the pump is configured to drive at least one piston to actuate the control valve and/or the ball valve.

14. The downhole valve system of claim 1, wherein the upper opening is configured to receive the fluid from the central bore, from a position uphole the ball valve, in response to fluid being injected into the downhole tubular from surface and the control valve being in the open position or an intermediate position, and wherein the lower opening is configured to output the fluid into the central bore to a position downhole the ball valve.

15. The downhole valve system of claim 1, wherein the lower opening is configured to receive the production fluid from the central bore, from a position downhole the ball valve, in response to fluid flowing uphole through the downhole tubular and the control valve being in the open position or an intermediate position, and wherein the upper opening is configured to output the fluid into the central bore to a position uphole the ball valve.

16. The downhole valve system of claim 1, wherein the ball valve includes a main bore extending through a first portion of the ball valve and at least one ball slot extending through a second portion of the ball valve, wherein the ball valve is configured to rotate to align the main bore with the central bore in the open orientation, and wherein the ball valve is configured to rotate to align the at least one ball slot with the central bore in a partially open orientation.

17. A downhole valve system, comprising:

a downhole tubular having body portion and a central bore extending axially through the body portion, wherein fluid is configured to flow along the central bore;

a bypass flow path extending axially through the downhole tubular, wherein the bypass flow path is in fluid communication with the central bore via an upper opening and a lower opening axially offset from the upper opening;

a control valve configured to control flow along the bypass flow path, wherein the control valve is configured to actuate between an open position, an intermediate position, and closed position to control the flow, wherein the control valve comprises:

a valve body disposed along the bypass flow path;

a first slot extending through the valve body;

a second slot extending through the valve body, wherein the second slot is axially offset from the first slot; and a control sleeve disposed within the central bore and configured to interface with the valve body as the control sleeve moves axially between the open position, the intermediate position, and the closed position, wherein the control sleeve is axially offset from the first slot and the second slot in the open position, wherein the control sleeve is axially aligned with the first slot and axially offset from the second slot in the intermediate position to permit flow through the first slot and block from flowing through the second slot, and wherein the control sleeve is axially aligned with the first slot and the second slot in the closed position to block flow through the first slot and the second slot; and a ball valve disposed within the central bore in an axial position between the upper opening and the lower opening, wherein the ball valve is configured to rotate between an open orientation to permit flow through the central bore and a closed orientation to block flow through the central bore, wherein the ball valve comprises:

a body portion; and a main bore extending through the body portion, wherein the main bore is aligned with the central bore in the open orientation to permit flow through the ball valve, and wherein the body portion is aligned with the central bore to block flow through the main bore in the closed orientation.

18. The downhole valve system of claim 17, wherein the control valve is disposed at the upper opening to control flow between the central bore and the bypass flow path via the upper opening.

19. The downhole valve system of claim 17, wherein a cross-sectional area of the bypass flow path is smaller than a cross-section area of the central bore such that blocking flow through the central bore and directing flow through the bypass flow path at least partially chokes flow through the downhole tubular.

20. A downhole valve system, comprising a downhole tubular having body portion and a central bore extending axially through the body portion, wherein production fluid is configured to flow along the central bore;

a bypass flow path extending axially through the downhole tubular, wherein the bypass flow path is in fluid communication with the central bore via an upper opening and a lower opening axially offset from the upper opening;

a control sleeve configured to move along the central bore between an open position and a closed position to control flow through the bypass flow path, wherein the control sleeve is offset from the upper opening in the open position to allow flow through the bypass flow path, and wherein the control sleeve is axially aligned with the upper opening in the closed position to allow flow through the bypass flow path;

a ball valve disposed within the central bore in an axial position between the upper opening and the lower opening, wherein the ball valve is configured to rotate between an open orientation, a partially open orientation, and a closed orientation to control the flow through the central bore;

a main bore extending through a first portion of the ball valve, wherein the ball valve is configured to rotate to align the main bore with the central bore in the open orientation; and at least one ball slot extending through a second portion of the ball valve, wherein the at least one ball slot is smaller than the main bore, and wherein the ball valve is configured to rotate to align the at least one ball slot with the central bore in the partially open orientation, and wherein a third portion of the ball valve is aligned with the central bore in the closed orientation to block fluid flow through the central bore.

21. A downhole valve system, comprising:

a downhole tubular having body portion and a central bore extending axially through the body portion, wherein production fluid is configured to flow along the central bore;

a bypass flow path extending axially through the downhole tubular, wherein the bypass flow path is in fluid communication with the central bore via an upper opening and a lower opening axially offset from the upper opening;

a control valve disposed along the bypass flow path to control flow along the bypass flow path, wherein the control valve is configured to actuate between an open position, a first intermediate position, a second intermediate position, and closed position to control the flow, wherein the control valve comprises:

a first slot extending between the central bore and the bypass flow path;

a second slot extending between the central bore and the bypass flow path, wherein the second slot is axially offset from the first slot;

a third slot extending between the central bore and the bypass flow path, wherein the second slot is positioned axially between the first slot and the third slot; and a control sleeve disposed within the central bore and configured to move axially along the central bore between the open position, the first intermediate position, the second intermediate position, and the closed position, to control flow through the first slot, the second slot, and the third slot;

a ball valve disposed within the central bore in an axial position between the upper opening and the lower opening, wherein the ball valve is configured to actuate between an open orientation to permit flow through the central bore and a closed orientation to block flow through the central bore, and wherein the control valve and the ball valve are configured to actuate to control fluid flow through the downhole tubular in a blocked flow state, an open flow state, a first partially choked state, a second partially choked state, and fully choked state, wherein the control valve is actuated to the closed position and the ball valve is actuated to the closed orientation in the blocked flow state to block fluid flow through the downhole tubular, wherein the ball valve is actuated to the open orientation in the open flow state to permit fluid flow through the central bore, wherein the control valve is actuated to the open position and the ball valve is actuated to the closed orientation in the first partially choked state to block fluid flow through the central bore and permit fluid flow through the bypass flow path via the first slot, the second slot, and the third slot, wherein the control valve is actuated to the first intermediate position and the ball valve is actuated to the closed orientation in the second partially choked state to block fluid flow through the central bore and permit fluid flow through the bypass flow path via the first slot and the second slot, and wherein the control valve is actuated to the second intermediate position and the ball valve is actuated to the closed orientation in the fully choked state to block fluid flow through the central bore and permit fluid flow through the bypass flow path via the first slot.

* * * * *